US009873029B1

(12) United States Patent
Sillies

(10) Patent No.: US 9,873,029 B1
(45) Date of Patent: Jan. 23, 2018

(54) GOLF CLUB HEAD

(71) Applicant: Wilson Sporting Goods Co., Chicago, IL (US)

(72) Inventor: Eric Sillies, Cincinnati, OH (US)

(73) Assignee: Wilson Sporting Goods Co., Chicago, IL (US)

( * ) Notice: Subject to any disclaimer, the term of this patent is extended or adjusted under 35 U.S.C. 154(b) by 0 days.

(21) Appl. No.: 15/276,960

(22) Filed: Sep. 27, 2016

Related U.S. Application Data

(60) Provisional application No. 62/379,189, filed on Aug. 24, 2016.

(51) Int. Cl.
*A63B 60/02* (2015.01)
*A63B 53/04* (2015.01)

(52) U.S. Cl.
CPC ..... *A63B 60/02* (2015.10); *A63B 53/0466* (2013.01); *A63B 2053/0433* (2013.01); *A63B 2053/0491* (2013.01)

(58) Field of Classification Search
CPC ..... A63B 60/02; A63B 53/04
See application file for complete search history.

(56) References Cited

U.S. PATENT DOCUMENTS 5,467,983 A 11/1995 Chen
5,582,553 A 12/1996 Ashcraft et al.
5,788,584 A 8/1998 Parente et al.
5,911,638 A 6/1999 Parente et al.
5,997,415 A 12/1999 Wood
6,126,556 A 10/2000 Hsieh
6,217,461 B1 4/2001 Galy
6,306,048 B1 10/2001 McCabe et al.
6,319,149 B1 11/2001 Lee
6,386,990 B1 5/2002 Reyes et al.
6,491,592 B2 12/2002 Cackett et al.
6,558,271 B1 5/2003 Beach et al.
6,739,984 B1 5/2004 Ciasullo
6,773,360 B2 8/2004 Willett et al.
6,849,003 B2 2/2005 Kumamoto
6,945,876 B2 9/2005 Nakahara et al.
6,974,393 B2 12/2005 Caldwell et al.
6,988,960 B2 1/2006 Mahaffey et al.
7,025,692 B2 4/2006 Erickson et al.
7,029,403 B2 4/2006 Rice et al.
7,108,609 B2 9/2006 Stites et al.
7,166,040 B2 1/2007 Hoffman et al.
7,166,041 B2 1/2007 Evans
7,189,165 B2 3/2007 Yamamoto
7,344,452 B2 3/2008 Imamoto et al.
7,371,191 B2 5/2008 Sugimoto
(Continued)

*Primary Examiner* — Michael Dennis
(74) *Attorney, Agent, or Firm* — Terence P. O'Brien; Todd A. Rathe

(57) ABSTRACT

A golf club head may include a body having a hollow interior and a removable sole plate. The body may include a hosel portion, a front strike face, a crown and a sole. The sole may include a floor and sidewalls extending from the floor to the crown, wherein the floor may have openings opening into the hollow interior. The removable sole plate mounted to the sole over the openings of the floor the sole plate may include wings and a tail. The wings are proximate the front strike face and curve along the sidewalls towards the crown. The tail extends from the wings away from the front strike face.

23 Claims, 10 Drawing Sheets

(56) References Cited

U.S. PATENT DOCUMENTS

| | | | | |
|---|---|---|---|---|
| 7,410,425 | B2 | 8/2008 | Willett et al. | |
| 7,438,649 | B2 | 10/2008 | Ezaki et al. | |
| 7,520,822 | B2 | 4/2009 | Yamagishi et al. | |
| 7,713,143 | B2 | 5/2010 | Evans | |
| 7,771,290 | B2 | 8/2010 | Bezilla et al. | |
| 7,828,673 | B2 | 11/2010 | Evans | |
| 7,993,216 | B2 | 8/2011 | Lee | |
| 8,192,302 | B2 | 6/2012 | Knutson et al. | |
| 8,197,357 | B1 | 6/2012 | Rice et al. | |
| 8,608,591 | B2 | 12/2013 | Chao et al. | |
| 8,663,030 | B2 | 3/2014 | Evans | |
| 8,876,629 | B2 | 11/2014 | Deshmukh et al. | |
| 8,968,116 | B1 | 3/2015 | Myers et al. | |
| 9,162,120 | B2 | 10/2015 | Jertson et al. | |
| 9,211,453 | B1 | 12/2015 | Foster et al. | |
| 9,339,701 | B2 | 5/2016 | Boggs | |
| 9,440,126 | B2 | 9/2016 | Boyd et al. | |
| 9,561,411 | B2 * | 2/2017 | Mizutani | A63B 53/0466 |
| 9,649,540 | B2 * | 5/2017 | Parsons | A63B 53/04 |
| 2002/0128089 | A1 * | 9/2002 | Sillers | A63B 53/0466<br>473/335 |
| 2007/0105657 | A1 * | 5/2007 | Hirano | A63B 53/0466<br>473/345 |
| 2013/0324290 | A1 * | 12/2013 | Oldknow | A63B 53/0466<br>473/324 |
| 2016/0236047 | A1 | 8/2016 | Chen et al. | |
| 2017/0050091 | A1 | 2/2017 | Shimahara et al. | |

* cited by examiner

GOLF CLUB HEAD

RELATED U.S. APPLICATION DATA

The present application is a non-provisional application claiming priority from U.S. Provisional Patent Application Ser. No. 62/379,189 filed on Aug. 24, 2016 by Eric Sillies and entitled GOLF CLUB HEAD, the full disclosure of which is hereby incorporated by reference.

FIELD OF THE INVENTION

The present disclosure relates generally to a golf club head for a golf club.

BACKGROUND OF THE INVENTION

Golf is a sport enjoyed by golfers of all ages and skill levels. Golfers at all levels continually strive to improve their game. One approach that many golfers use to improve their play is to customize their clubs to fit their game. Golf presents many challenges to golfers. For example, many golfers find their game changing over time. Additionally, golf courses present a variety of challenging holes that provide golfers the opportunity to use golf clubs of varying features and/or characteristics to best meet such challenges. As a result, golfers require a variety of different clubs to meet these challenges.

Although golfers may desire a large number of different clubs for their game, many practical considerations can prevent golfers from meeting this need. The 14 club rule in the Rules of Golf limits the number of clubs golfers can carry. Players, who prefer to carry their bags, often prefer to limit the number of clubs they carry to make the round more enjoyable and carrying their golf bag less burdensome. Another consideration is cost. Although players may desire three different drivers having different characteristics, many golfers simply can't justify the expense of purchasing such clubs.

Thus, a continuing need exists for a golf club that can be easily, simply and conveniently adjusted to obtain different golf club characteristics. What is needed is a golf club that performs well, and allows for the player to quickly and easily adjust the club head to match the golfer's particular needs or objectives at that time. There is a need for a club head that can be readily adjusted into a variety of different settings thereby eliminating the need for the golfer to carry multiple clubs to meet the different desired settings. Further, there is a need for a golf club that meets these needs while also providing an improved, pleasing aesthetic.

SUMMARY

A golf club head may include a body having a hollow interior and a removable sole plate. The body may include a hosel portion, a front strike face, a crown and a sole. The sole may include a floor and sidewalls extending from the floor to the crown, wherein the floor may have openings opening into the hollow interior. The removable sole plate mounted to the sole over the openings of the floor the sole plate may include wings and a tail. The wings are proximate the front strike face and curve along the sidewalls towards the crown. The tail extends from the wings away from the front strike face.

A sole plate for a golf club head may include a front edge to be positioned proximate a strike face of the golf club head, a breast having a top face facing in an upwards direction to face a sole of a golf club head, wings laterally extending from the breast and forming the front edge and a rearwardly extending from the breast. The wings may curve away from the breast in the upwards direction.

A golf club head body for use with a set of interchangeable sole plates to form a golf club head may include a hollow interior, a hosel portion, a front strike face, a crown and a sole. The sole may include a bottom and sidewalls extending from the bottom to the crown. The sole may further include an upwardly extending recess extending into the bottom and the sidewalls, wherein the upwardly extending recess is to receive one of the interchangeable sole plates. The upwardly extending recess may have a ceiling with openings that open into the hollow interior, wherein the openings extend over at least 20% of the sole.

DETAILED DESCRIPTION OF EXAMPLE EMBODIMENTS

Figure 1:
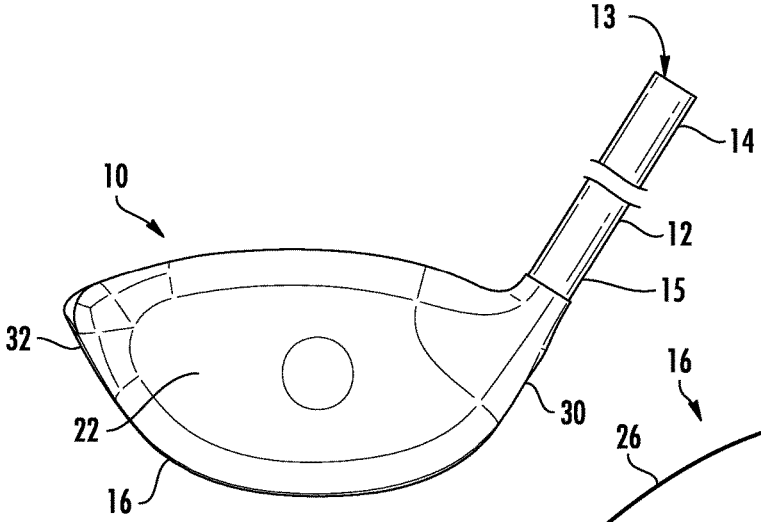
FIG. 1 is a front view of an example golf club.
Figure 2:
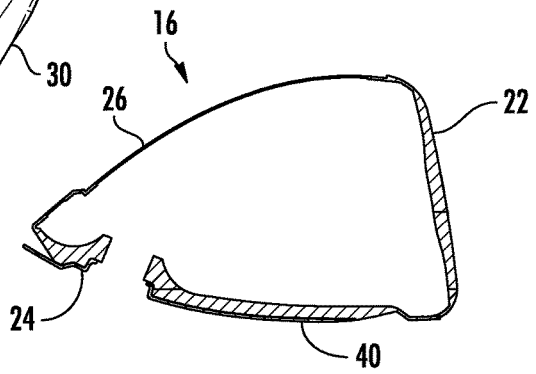
FIG. 2 is a longitudinal cross-sectional view of the golf club head of FIG. 1.

FIGS. 1 through 20 illustrate an example golf club is indicated generally at 10. The golf club 10 of FIG. 1 is configured as a driver. The various features of the example golf club 10 can also be formed as, and are directly applicable to, fairway woods and combinations thereof in sets of golf clubs. As illustrated by FIG. 1, golf club 10 is an elongate implement configured for striking a golf ball. Golf club 10 comprises a golf shaft 12 having a butt end 13 with a grip 14 and a tip end 15 coupled to a golf club head 16.

The shaft 12 is an elongate hollow tube extending along a first longitudinal axis. The shaft 12 tapers toward the tip end 15. The shaft 12 is formed of a lightweight, strong, flexible material, preferably as a composite material. In alternative embodiments, the shaft 12 can be formed of other materials such as, other composite materials, steel, other alloys, wood, ceramic, thermoset polymers, thermoplastic polymers, and combinations thereof. The shaft can be formed as one single integral piece or as a multi-sectional golf shaft of two or more portions or sections.

As used herein, the term "composite material" refers to a plurality of fibers impregnated (or permeated throughout) with a resin. The fibers can be co-axially aligned in sheets or layers, braided or weaved in sheets or layers, and/or chopped and randomly dispersed in one or more layers. The composite material may be formed of a single layer or multiple layers comprising a matrix of fibers impregnated with resin. In particularly preferred embodiments, the number layers can range from 3 to 8. In multiple layer constructions, the fibers can be aligned in different directions with respect to the longitudinal axis 18, and/or in braids or weaves from layer to layer. The layers may be separated at least partially by one or more scrims or veils. When used, the scrim or veil will generally separate two adjacent layers and inhibit resin flow between layers during curing. Scrims or veils can also be used to reduce shear stress between layers of the composite material. The scrim or veils can be formed of glass, nylon or thermoplastic materials. In one particular embodiment, the scrim or veil can be used to enable sliding or independent movement between layers of the composite material. The fibers are formed of a high tensile strength material such as graphite. Alternatively, the fibers can be formed of other materials such as, for example, glass, carbon, boron, basalt, carrot, Kevlar®, Spectra®, poly-paraphenylene-2,6-benzobisoxazole (PBO), hemp and combinations thereof. In one set of preferred embodiments, the resin is preferably a thermosetting resin such as epoxy or polyester resins. In other sets of preferred embodiments, the resin can be a thermoplastic resin. The composite material is typically wrapped about a mandrel and/or a comparable structure, and cured under heat and/or pressure. While curing, the resin is configured to flow and fully disperse and impregnate the matrix of fibers.

FIGS. 2-8 illustrate golf club head 16 in more detail. As shown by FIGS. 2-8, golf club head 16 comprises body 20, sole plate 40 and removable weights 42. Body 20 comprises a hollow structure that is coupled to the shaft. For purposes of this disclosure, the term "coupled" shall mean the joining of two members directly or indirectly to one another. Such joining may be stationary in nature or movable in nature. Such joining may be achieved with the two members or the two members and any additional intermediate members being integrally formed as a single unitary body with one another or with the two members or the two members and any additional intermediate member being attached to one another.

In one implementation, the body 20 of the club head 16 can be formed as a single unitary, integral body through a combination of casting and welding. In another implementation, the club head 16 can be formed through a combination of forging and welding. In other implementations, the components of the body 20 of the club head 16 can be formed through casting, forging, welding, molding or a combination thereof. The body 20 of the club head 16 comprises a generally vertical front striking plate or strike face 22, a sole 24, a crown 26 and a hosel portion 28. The striking plate 22 extends from a heel portion 30 to a toe portion 32 of the club head 10.

As shown by FIGS. 3-7, the sole 24 and the crown 26 rearwardly extend from lower and upper portions of the striking plate 22, respectively. The sole 24 generally curves upward to meet the generally downward curved crown 26. The portion of the sole 24 adjacent the crown 26 that connects the sole 24 to the crown 26 at perimeter locations other than at the striking plate 22 can be referred to as a side wall 34 or skirt.

Figure 7:
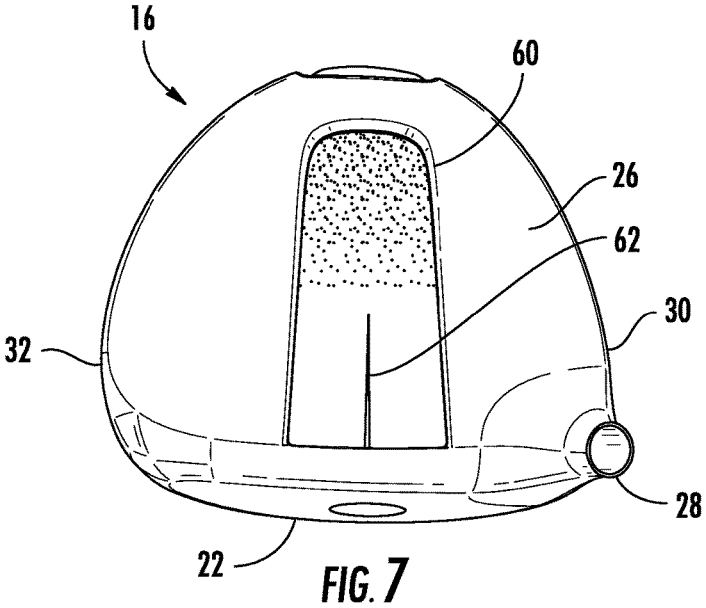
FIG. 7 is a top view of the golf club head of FIG. 1.

As shown by FIG. 7, crown 26 of the body 20 includes a central recessed region 60 that provides for and/or forms a sightline for the club head. The recessed region 60 can extend across the central area of the crown 26 from near the strike face 22 rearwardly toward the rear end of the club head 20. The recessed region 60 can have a length (measured from the strike face 22 rearward) of at least one inch and a width of at least 0.5 inches. In another implementation, the recessed region 60 can have a length of at least 2 inches and a width of at least 0.75 inch. In another implementation, the recessed region 60 can have a width that is approximately the same as the width of a golf ball, 1.680 inches. The recessed region 60 can have a length of approximately 3 inches. In other implementations, the recessed region 60 can have other dimensions. The recessed region 60 can be formed with a color that is different from the color of the other portions of the crown 26. In one implementation, the color of the recessed region 60 can be lighter than the color of the remaining portions of the crown 26. In another implementation, the color of the recessed region 60 can be darker than the color of the remaining portions of the crown 26. In another implementation, the recessed region 60 can include two or more colors. In another implementation, the recessed region 60 can include a color transition from a first color to a second color (or more colors). In one implementation, the front portion of the recessed region 60 has a white color to match the color of a golf ball.

The recessed region 60 can further include a narrow sight marker 62 positioned at the strike face 22 portion of the recessed region 60 and extending rearward over a portion of the recessed region 60. The sight marker 62 is centered about the strike face 22 and forms a ball alignment marker or ball sight for the user. The sight marker 62 is formed of a color that contrasts the color of the recessed region 60 surrounding the sight marker 62.

Figure 6:
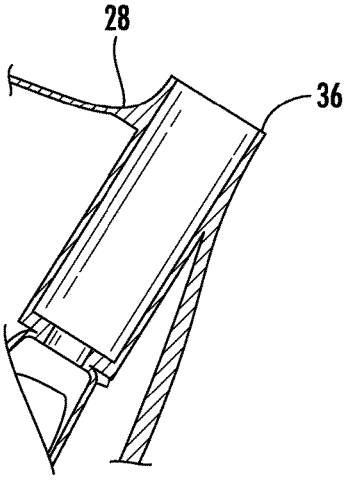
FIG. 6 is a cross-sectional view of a hosel of the golf club head of FIG. 1.

As shown by FIG. 6, the hosel portion 28 is a generally cylindrical body that upwardly extends from the crown 26 at the heel portion 30 of the club head 16 to couple the club head 16 to the shaft 12. The hosel portion 28 defines an upper hosel opening 36 for receiving the tip end of the shaft 12. The body 20 of the club head 16 is made of a high tensile strength, durable material, preferably a stainless steel or titanium alloy. Alternatively, the body 20 of the club head 16 can be made of other materials, such as, for example, a composite material, aluminum, other steels, metals, alloys, wood, ceramics or combinations thereof.

Figure 8:
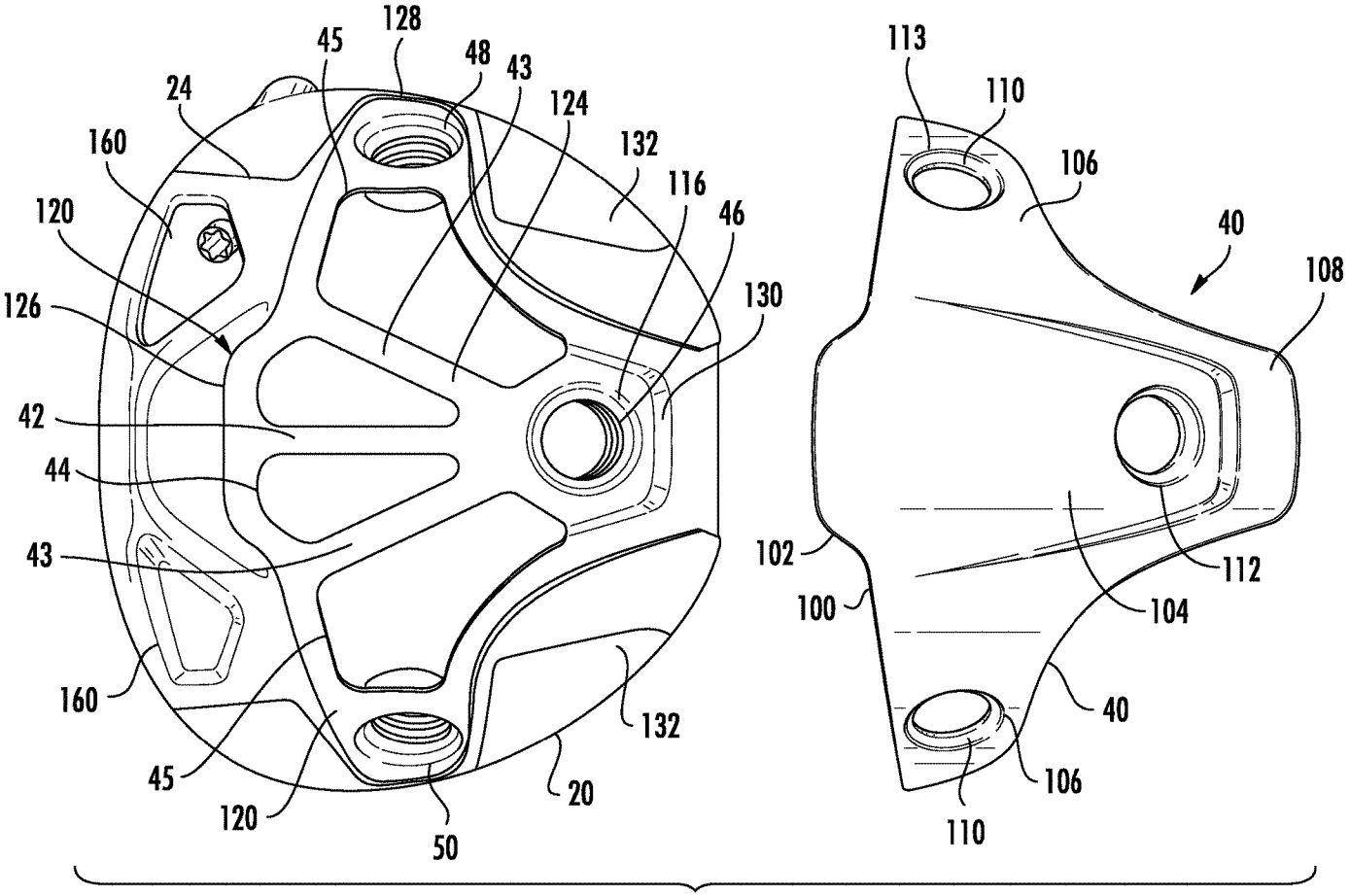
FIG. 8 is a bottom perspective view of the golf club head of FIG. 1 with the removable sole plate shown removed from the body of the golf club head.
Figure 9:
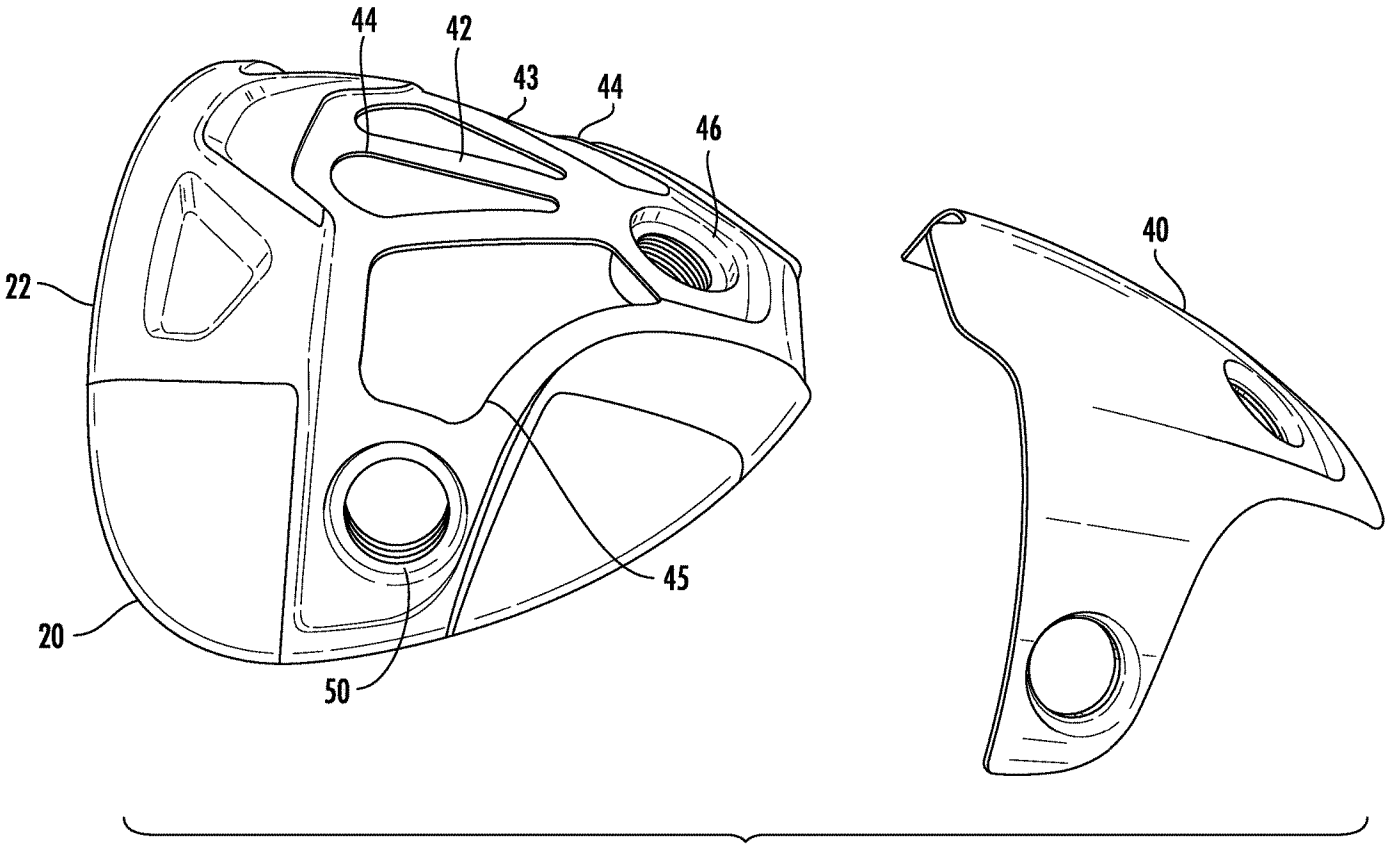
FIG. 9 is a toe end perspective view of the golf club head and sole plate of FIG. 17.
Figure 10:
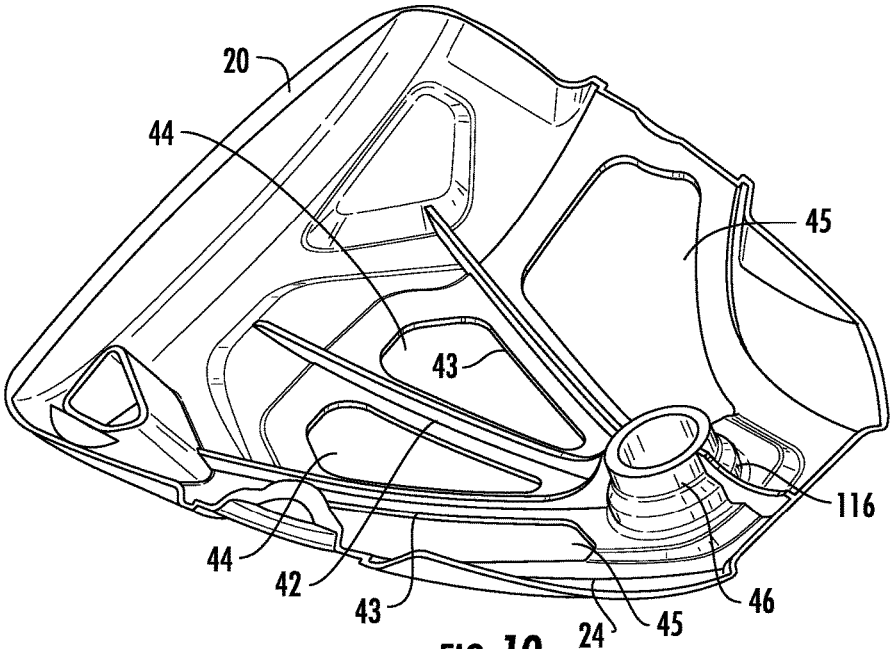
FIG. 10 is a fragmentary sectional view of a portion of an interior of the bottom of a sole of the golf club head of FIG. 1.

FIGS. 8 and 9 are exploded perspective views of head 16 illustrating sole 24 of body 20 in more detail. FIG. 10 is a sectional view illustrating an inside portion of the body 20 that forms sole 24. As shown by FIGS. 8-10, the sole 24 of the body 20 is formed with a set of structural ribs, including a center rib 42 and angled ribs 43, that define, with the remaining portions of the sole 24, a set of openings 44, 45. Center rib 42 extends along the centerline of head 16, opposite to and parallel to sight line 62. Openings 44 extend on opposite sides of center rib 42. Openings 45 extend on opposite sides of angled ribs 43 as openings 44. Openings 45 extend upwardly along sides of sole 24. In the example illustrated, openings 44 and 45 on one side of center rib 42 mirror of the openings 44 and 45 on the other side of center rib 42, providing symmetrical weight distribution along the centerline (and sight line 62) of head 62. In other implementations, such ribbing and openings may have other configurations.

Figure 3:
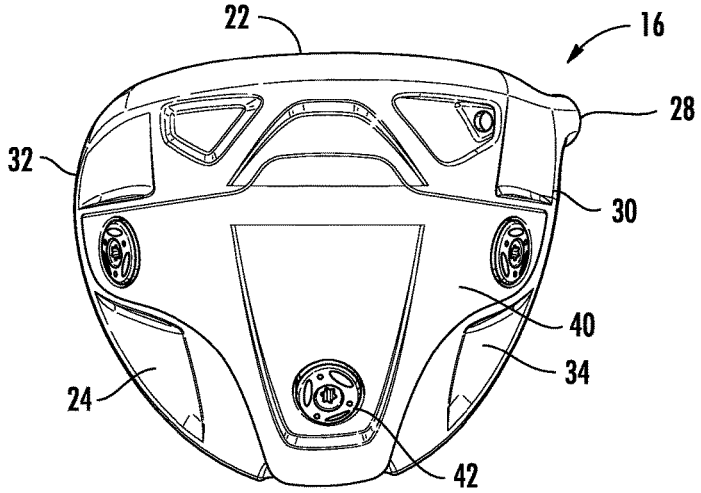
FIG. 3 is a bottom view of the golf club head of FIG. 1.

The openings 44, 45 and ribs 42 43 of the sole 24 enable the weight of the sole 24 of the body 20 to be reduced. The openings 44, 45 also allow for the interior of the body 20 to be seen and visible and for any debris, or any particles or flakes that may break free from other locations of the body 20, to be readily removed from the body 24 by simply turning the body 24 such that the openings 44, 45 are orientated downward and the debris or other particles can be easily removed by gravity. The open structure of the sole 24 also eliminates the need to add a layer, or sections, of tacky material that is commonly utilized within many conventional club heads. The tacky material is intended to retain any particles or flakes that may break free from the club head during use or over time. Such particles or flakes have been known to cause a rattle or other noise that can be negatively received by the user. The absence of the tacky material due to the presence of the openings 44, 45 further reduces the weight of the body 20. The sole 24 defines a sole surface area, which is the lower surface of the club head 16 as shown in FIG. 3. In one implementation, the total area of the sole surface area can be 21.21 $in^2$. In one implementation, each of the openings 44 define an area of approximately 0.556 $in^2$, the opening 45 closer to the toe of the club head 16 defines an area of approximately 1.406 $in^2$, and the opening 45 closer to the heel of the club head 16 defines an area of approximately 1.0954 $in^2$. Accordingly, the openings 44 and 45 have a collective area of approximately 3.6173 $in^2$. In this implementation, the openings 44 and 45 extend over approximately 17.05 percent of the sole surface area. In other words, the collective area of openings 44, 45 extend over at least 17 percent of the sole 24. The collective area of the openings 45 extend over approximately 11.8 percent of the sole surface area of the sole 24. The collective area of the openings 44 extend over approximately 5.25 percent of the sole surface area of the sole 24. Accordingly, in one implementation, the collective area of the openings 45 extend over at least 11 percent of the sole surface area. Additionally, in one implementation, the collective area of the openings 44 extend over at least 5 percent of the sole surface area. In other implementations, the openings 44 and 45 can define other areas. In another implementation, the collective area of openings 44 and 45 extend over at least 15 percent of the sole surface area of the sole 24. In another implementation, the collective area of the openings 44 and 45 define at least 20 percent of the sole surface area. In other implementations, the collective area of openings 44 and 45 can be sized to extend over at least 30 percent, 40 percent or 50 percent of the sole surface area of the sole 24.

The sole 24 includes a set of three threaded bores 46, 48 and 50. The first threaded bore 46 is positioned toward the rear of the sole 24, and the second and third threaded bores 48 and 50 of the sole are positioned on the skirt or sidewall of the sole toward the heel and toe of the body 20, respectively.

FIGS. 8, 9, 11 and 12 illustrate removable sole plate 40 in more detail. The removable sole plate 40 extends over the openings 44 and 45 of the sole 24 of the body 20, and the three threaded bores 46, 48 and 50. In the example illustrated, sole plate 40 comprises a front edge 100, a neck portion 102, a central breast 104, wings 106 and a tail 108. Front edge 100 comprises the forward edge of plate 40 which extends proximate to strike face 22 when plate 40 is mounted to head 16. Neck portion 102 extends forwardly from breast 104 so as to extend along and form a part of front edge 100.

Breast 104 extends between neck portion 102 and tail 108. Breast 104 forms the flat lower surface, covering the flat bottom of sole 24 of head 16. Breast 104 extends across and covers the openings 44 between ribs 42 and 43.

Figure 11:
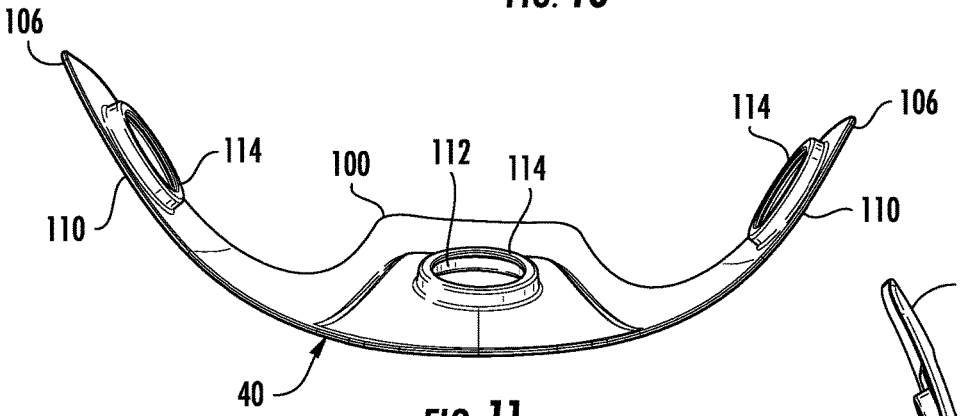
FIG. 11 is a front view of an example sole plate of the golf club head of FIG. 1.
Figure 12:
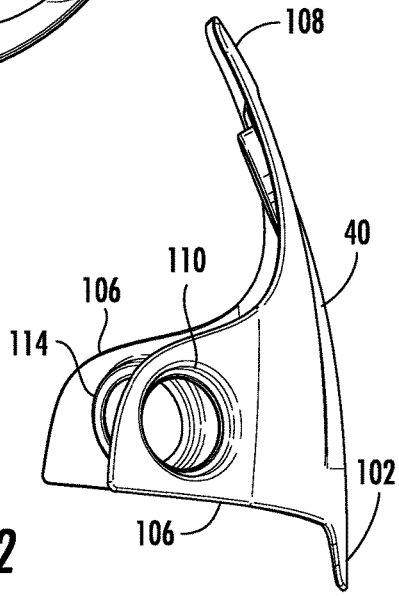
FIG. 12 is a side view of the example sole plate of FIG. 11.
Figure 13:
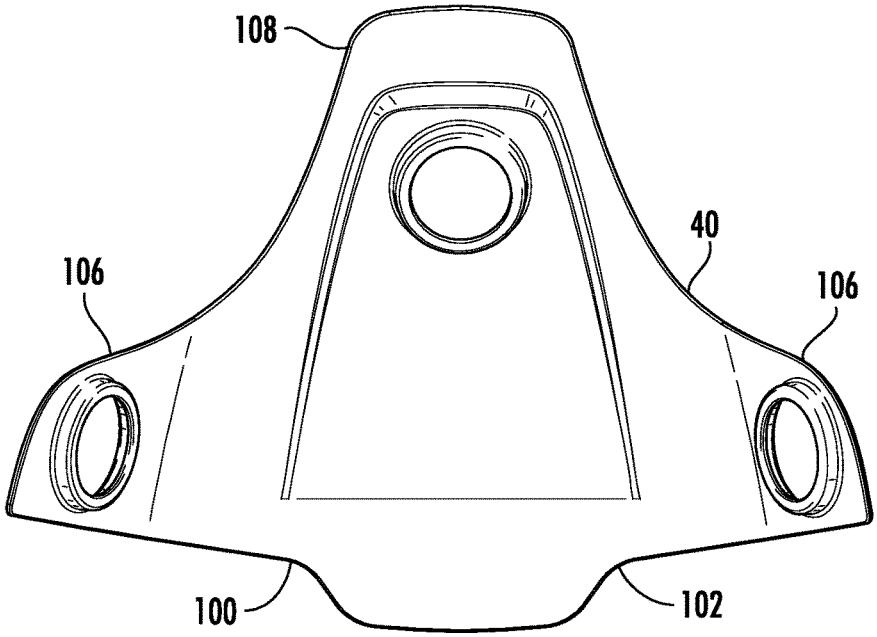
FIG. 13 is a bottom view of the example sole plate of FIG. 11.

Wings 106 laterally extend from breast 104 and form portions of front edge 100 on opposite side of neck portion 102. As best seen in FIGS. 11 and 12, wings 106 curve away from breast portion 106 in an upward direction so as to wrap about the sides or skirt of head 16 when sole plate 40 is mounted to head 16. As a result, wings 106 distribute a customizable weight of sole plate 40 not just along the bottom of head 16, but also along the sides of head 16, along a majority of strike face 22, from the heel to the toe of head 16. Because wings 106 wrap about the underside of sole 24, sole plate 40 is more than a simple plate appended to the bottom side of sole 24, wherein wings 106 provide enhanced weight distributional along the sides of body 20 and more reliably and stably secure sole plate 40 to body 20.

Figure 4:
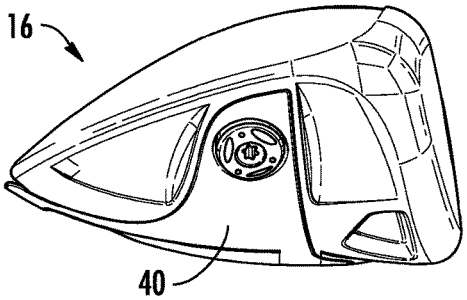
FIG. 4 is a toe end view of the golf club head of FIG. 1
Figure 5:
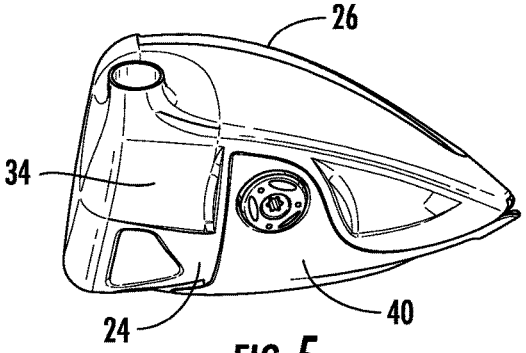
FIG. 5 is a heel end view of the golf club head of FIG. 1.

Tail 108 extends rearwardly from breast 104 and rearwardly from wings 106, in a direction away from neck 102 and strike plate 22. As shown by FIGS. 4 and 5, the example illustrated, tail 108 extends upwardly as it extends rearwardly, approaching the top or crown of head 16. As a result, wings 106 and tail 108 form a cup-shaped plate into which body 20 is received (or which is removably applied to the body 20). Tail 108 provides additional weight is generally centered along the centerline of head 16, parallel to or along sightlines 62 (described above).

Wings 106 and tail 108 form a generally T-shaped structure, wherein wings 106 extend parallel or at least substantially parallel to the front strike face 22, providing rigidity and further distributing weight along and close proximity to front strike 22. Wings 106 and tail 108 each include mounting apertures through which removable weights 42, also serving as fasteners, extend into engagement with the threaded bores 46, 48 and 50. Wings 106 each include side mounting apertures 110 while tail 108 includes tail mounting aperture 112. Side mounting apertures 110 extend through the upwardly curving portions of wings 106 for being aligned with threaded bores 48 and 50 along the skirt of club head 16 on opposite sides of the centerline of club head 16. Tail mounting aperture 112 extends through tail 106 proximate a rear of head 16. In the example illustrated, each of apertures 110, 112 comprise counter sinks 113 for receiving portions of weights 42.

As shown by FIGS. 10-13, each of apertures 110, 112 is bordered and surrounded by a tube 114 projecting from the inner surface of sole plate 40. Tubes 114 are received within corresponding countersink bores 116 formed in sole 24 above threaded bores 46, 48 and 50. Tubes 114 and countersinks 116 facilitate securement, alignment and retention of sole plate 40 relative to sole 24 independent of weights 42. In other implementations, tubes 114 and/or countersinks may be omitted.

As further shown by FIGS. 8 and 9, sole plate 40 is sized and shaped or configured so as to fit within a recess 11 formed in sole 24. Recess 120 has an upper ceiling formed by ribs 42 and perimeter surfaces extending about countersinks 116 and threaded bores 46, 48 and 50. In the example illustrated, recess 120 comprises a central breast receiving portion 124, a neck recess 126, wing recesses 128 and a tail recess 130. Central breast receiving portion 124 of recess 120 extends below openings 44. Wing recesses 128 extend below openings and contain bores 48, 50. Tail recess 130 contains bore 46.

In the example illustrated, portions of sole 24 not occupied by recess 120 are further provided with additional cavities or recesses, reducing the weight of head 16 and providing additional structural strength about recess 120. In the example illustrated, sole 24 additionally comprises front side recesses 160 and rear side recesses 132. Front side recesses 160 have ceilings and sidewalls projecting upward into sole 24. Front side recesses 160 are each located between respective wing recesses 128 and strike face 22 on opposite sides of head 16. Likewise, rear side recesses 132 have ceilings and sidewalls projecting upward from into sole 24. Rear side recesses 132 are each located between respective wing recesses 128 and the rear or tale of club head 16.

Figure 15:
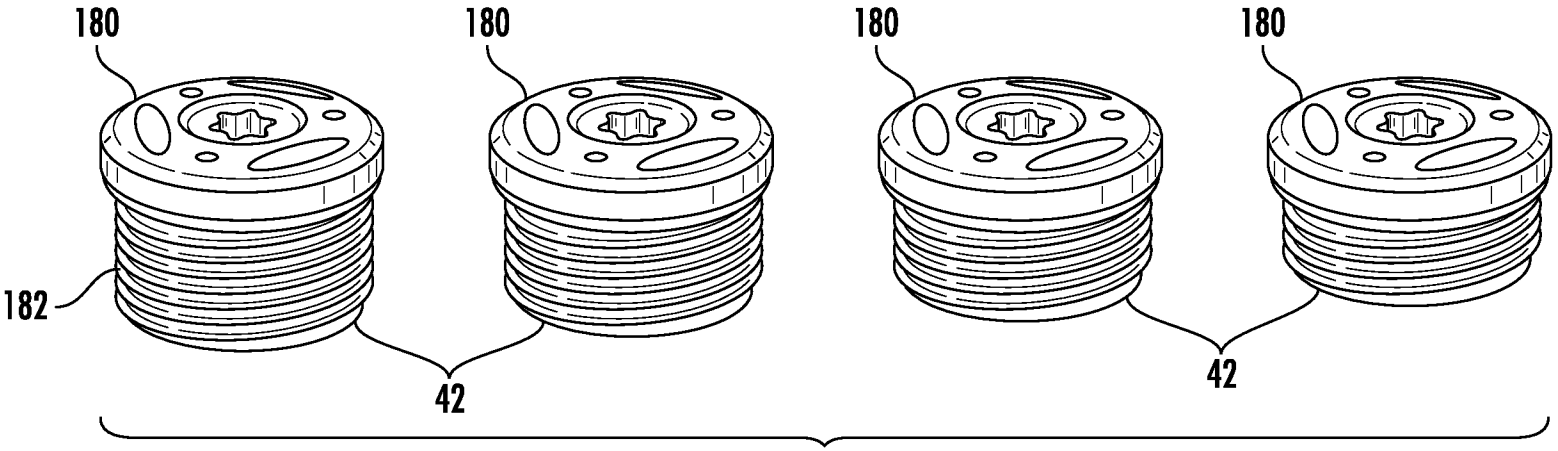
FIG. 15 is a top perspective view of an example set of weights of the example golf club head of FIG. 1.

FIG. 15 illustrates sole plate 40 received within recess 120, prior to the insertion of weights 42. In the example illustrated, recess 120 has a depth corresponding to the thickness of sole plate 40 such that when sole plate 40 has been received within recess 120, the lower face of sole plate 40 is substantially flush with the lower surfaces of sole 24 that are not covered by sole plate 40 and that extend adjacent to recess 120 of sole plate 40. The interaction between the side edges of sole plate 40 in the sidewalls are internal edges of recess 120 further assist in retaining sole plate 40 in place.

Figure 14:
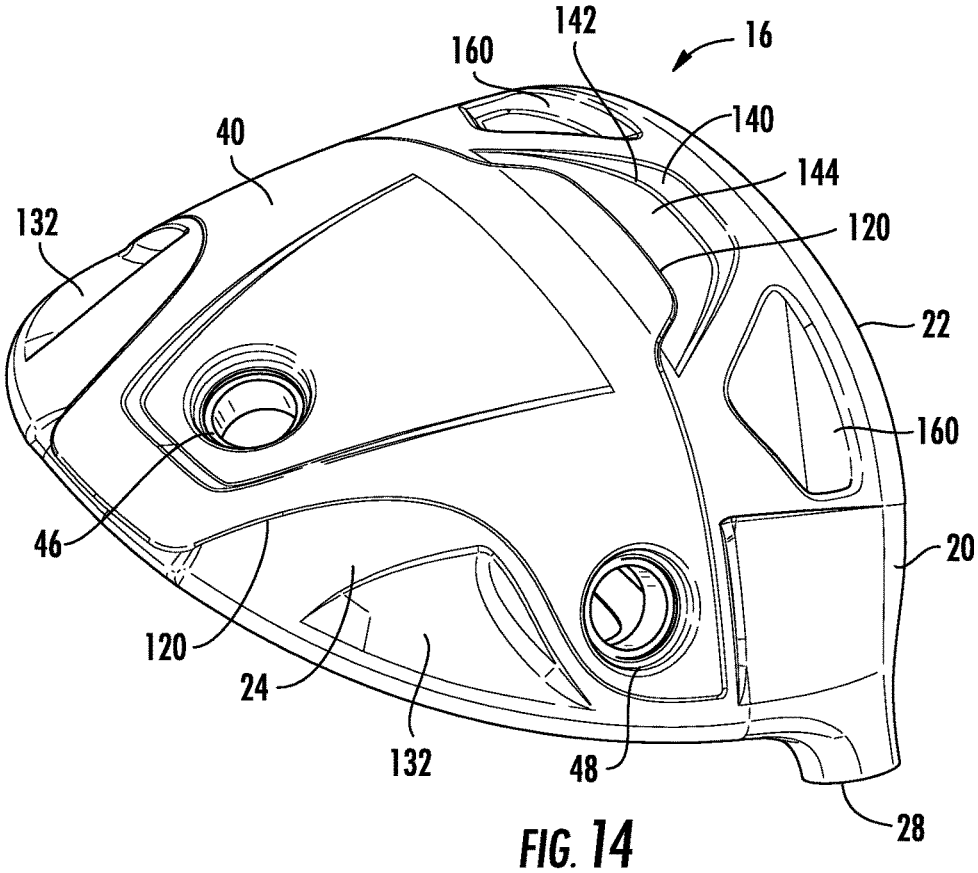
FIG. 14 is a bottom perspective view of the example sole plate of FIG. 11 aligned with a body of the example golf club head of FIG. 1.

As further shown by FIG. 14, in the example illustrated, recess 120 is itself recessed with respect to the front of sole 24. In particular, the sole 24 comprises a downwardly extending wall 140 extending along the front strike face 22 about a first upwardly extending recess 142 behind the downwardly extending wall. Recess 142 has a ceiling 144 in which recess 120 is recessed in a further upward direction, rejecting further into ceiling 144. In other implementations, the additional recess 142 and/or additional wall 140 may be omitted.

In one implementation, the club head 16 can be produced with a single removable sole plate 40. In another implementation, the club head 16 can be sold or configured with one or more extra or spare sole plates. The sole plates 40 can have different weights, different textures, different colors, different graphics, different indicia and combinations thereof. In another implementation, the club head 16 can be sold or configured as a set with three or more weights 52 and two or more removable sole plates 40 that provide the user with a large number of different options for customizing the weight, weight distribution and appearance of the club head. The present invention allows for a high degree of customization and adjustability of the club head.

The removable sole plate 40 can be formed of a composite material. In another implementation, the sole plate 40 can be formed of an alloy, such as a titanium alloy or an aluminum alloy. In other implementations, the removable sole plate can be formed of other alloys, other metals, a composite/metal hybrid, or combinations thereof. The body 20 of the club head 16 is made of a high tensile strength, durable material, preferably a stainless steel or titanium alloy. Alternatively, the body 20 of the club head 16 can be made of other materials, such as, for example, a composite material, aluminum, other steels, metals, alloys, wood, ceramics or combinations thereof.

Figure 16:
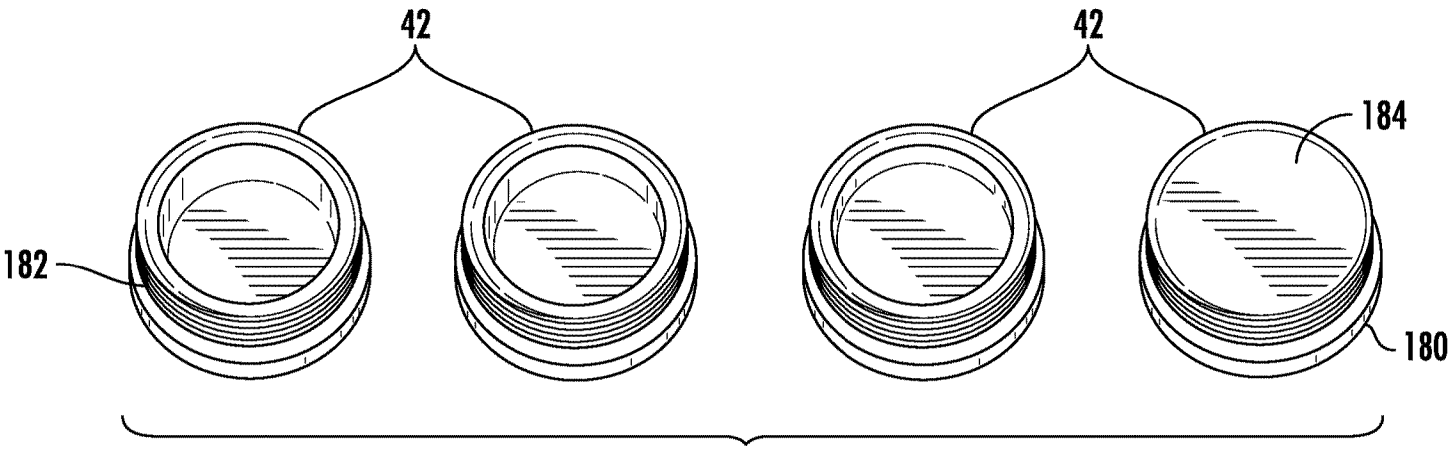
FIG. 16 is a bottom perspective view of the example set of weights of FIG. 15.
Figure 17:
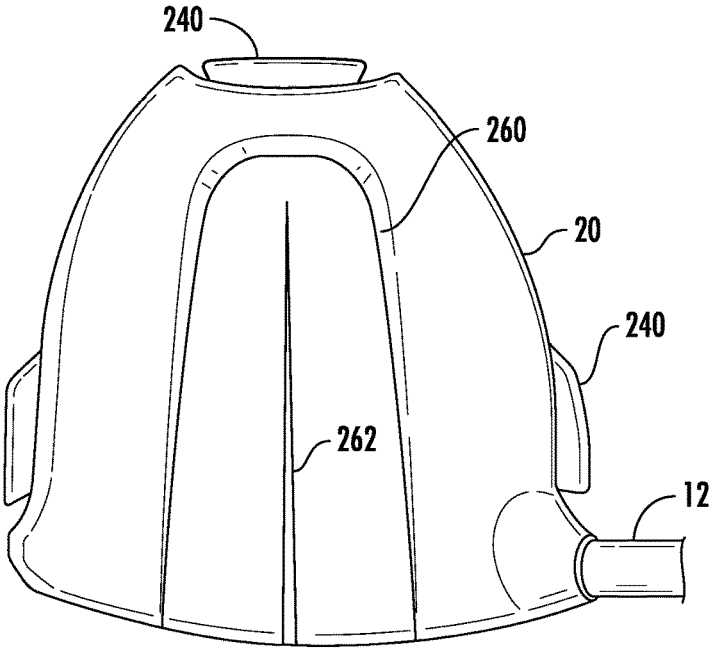
FIG. 17 is a top view of another example golf club head.
Figure 18:
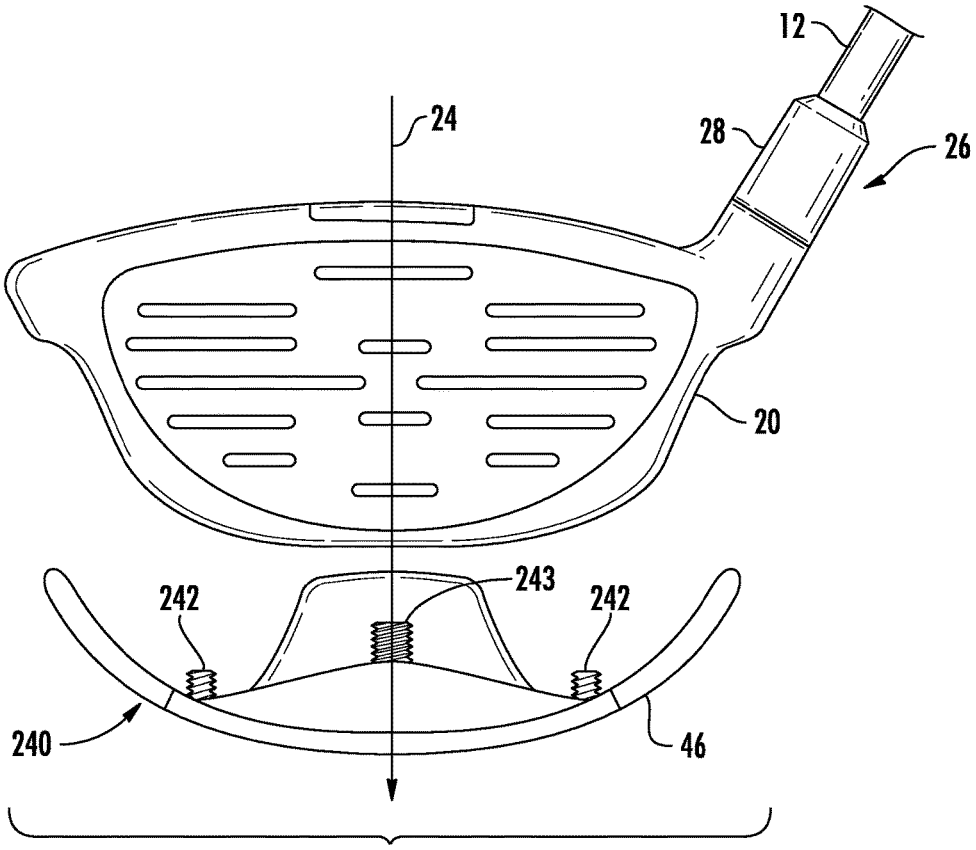
FIG. 18 is an exploded front view of the golf club head of FIG. 17.

FIGS. 15 and 16 illustrate removable weights 42 in more detail. The set of removable weights 42 comprises threaded fasteners that removably connect the removable sole plate 40 to the body 20 of the club head 16. The weights 42 are threadedly engaged with the bores 46, 48 and 50 to removeably connect or retain the sole plate 40 to the body 20. Each weight 42 is configured to be positioned within any of the three threaded bores 46, 48 and 50. The weights 42 can have a weight within the range of 1 gram to 20 grams. In one implementation, each weight 42 has a weight within the range of 2 to 12 grams. The club head 16 can include 3 weights and each weight can have the same weight. Alternatively, the set of 3 weights can include two weights of the same weight and the third weight of a different weight. In another implementation, each of the three weights can be different weights. In other implementations, the club head can be configured with one or more extra or spare weights that provide the user with greater flexibility in adjusting the overall weight of the club head, and the weight distribution or configuration of the club head. The weights 42 are formed of one or more alloys. In other implementations, the weights can be formed of a heavy metal, other alloys, and combinations thereof.

As further shown by FIGS. 15 and 16, each of removable weights 42 has larger head portion 180 and a smaller diameter threaded shaft portion 182. Head portion 180 is configured to be engaged by a tool to facilitate removal and insertion of each weight 42 with respect to sole plate 40 and sole 24. As shown by FIG. 3, each head portion 180 is received within the countersinks 113 with the bottoms of weights 42 being flush with sole plate 40. As further shown by FIG. 3, weights 42 positioned within bores 48 and 50 are located on the side or skirt of head 16 to provide additional weight along the side of head 16, vertically above the lower surface of head 16. In one implementation, when the club head is positioned along a ground plane or horizontal surface such as shown in FIGS. 1, 4 and 5, the head portion 180 of weights 42 positioned within the bores 48 and 50 are spaced apart by a ground plane or a horizontal surface by at least 0.5 inch. In other words, the entire head portion 180 is at least 0.5 in above a ground plane or horizontal surface when the club head 16 is positioned in an address position as shown in FIGS. 1, 4 and 5. In addition to providing enhanced weight distribution, the positioning of weights 42 along the sides of head 16 reduces the likelihood that such weights 42 will be brought into contact with the ground during a golf swing. As a result, the lateral or side positioning of such weights 42, wherein weights 42 extending along axes that are oblique or angle with respect to the horizontal and with respect to the bottom of head 16, reduces the likelihood that such weights 42 one go impact that may loosen sole plate 40 with respect to body 20 of head 16. As shown in FIG. 15, in one implementation the threaded shaft portion 182 of the weights 42 can have similar lengths and dimensions even though the weights may have different values (the amount of weight in grams may vary from one weight 42 to the next). As shown in FIG. 16, the similarly sized threaded shaft portion 182 can be maintained on weights 42 of different values by the location of a lower surface 184 of the weights 42. A heavier weight will have its lower surface substantially equal to the lower end of the shaft portion 182, while lighter weights will have the lower surface 184 further into the threaded shaft portion 182 thereby resulting in a lower weight due to less material being used in the weight. One advantage of the similarly sized shaft portion 182 is that it provides sufficient threads for engagement between the sole plate 40 and the sole 24 of the body 20. In other embodiments, the weights 42 can be varied by other means, such as by varying the density of the material or materials used to produce the weights or other means.

FIGS. 17-20 illustrate golf club 210, another example implementation of golf club 10. Golf club 210 is similar to golf club 10 described above except that golf club 10 comprises golf club head 216 in lieu of golf club head 16. Golf club head 216 is itself similar to golf club head 16 except that head 216 comprises removable sole plate 240 and removable weights 242, 243. The body 20 includes a central recessed region 260 that provides for and/or forms a sightline for the club head. The recessed region 260 can further include a narrow sight marker 262 positioned at the strike face portion of the recessed region 260 and extending rearward over a portion of the recessed region 260. Those remaining components of golf club 210 which correspond to components of golf club 10 are numbered similarly.

Sole plate 240 is similar to sole plate 40 described above except that sole plate 240 has a rounded or curved front edge 300, more closely matching the rounded or curved strike face 22 of head 216. Sole plate 240 comprises mounting apertures 310, 312 through which weights 242, 243 extend into engagement with corresponding threaded bores 46, 48 and 50 in body 20 of head 216. The club head 216 further includes a groove 250 defined by the forward portion of the sole 224 and a forward region 252 of the sole plate 240. The groove 250 extends from the heel to the toe of the club head 216, and can follow or correspond to the curvature of the face or strike plate 22 of the club head 216.

Weights 242, 243 are similar to weights 42 described above in that weights 242, 243 are each configured to extend through sole plate 240 while being threaded into their corresponding threaded bores in body 20 of head 216. In the example illustrated, weights 242 have a size smaller than weight 243 and passed through wings 106 of sole plate 40.

Figure 19:
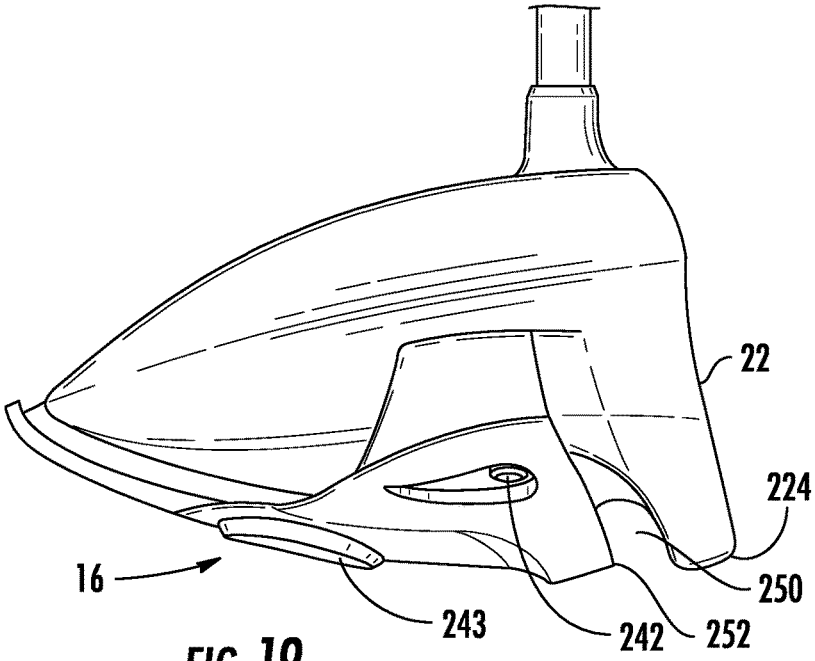
FIG. 19 is a side view of the example golf club head of FIG. 17.
Figure 20:
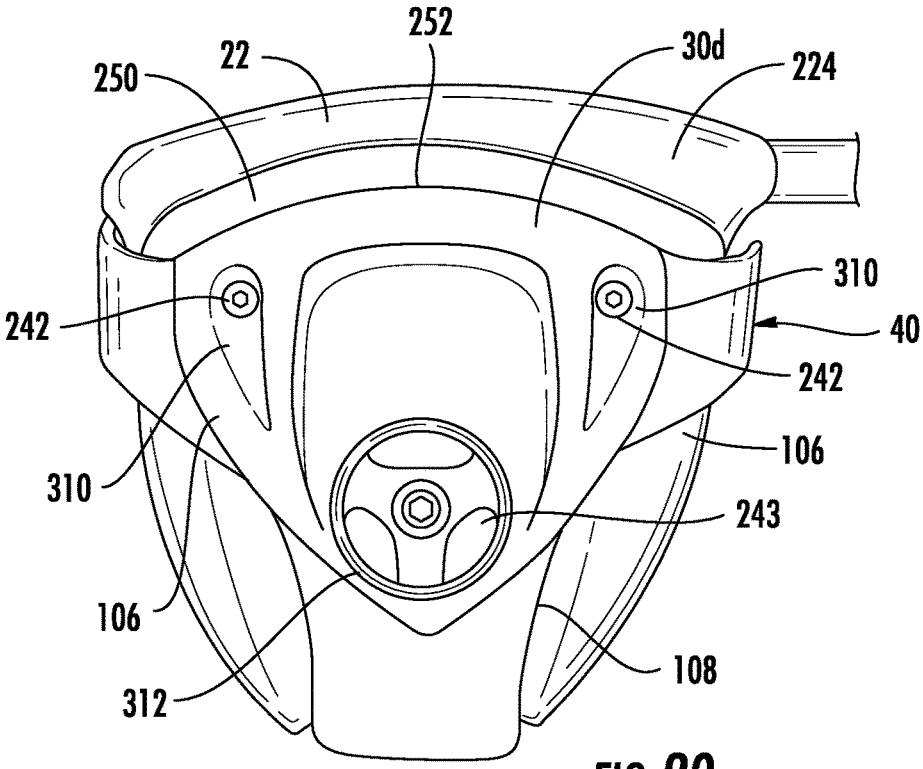
FIG. 20 is a bottom view of the example golf club head of FIG. 17.

Weight 243 has a size and weight larger than weights 242 and extends through a front portion of tail 108. As shown by FIG. 19, in the example illustrated, each of weights 242, 243 extend along axes that are parallel to a common transverse plane 247, in a general vertical direction. As shown by FIG. 20, weights 242 have had portions that are located vertically above the head portion of weight 243. In the example illustrated, weight 243 extends along a centerline or axis that is angled forward, toward strike face 22.

Weight 243 may have a weight within the range of 1 gram to 20 grams. In one implementation, weight 243 has a weight within the range of 2 to 12 grams. In other implementations, golf club head 216 may include additional weights 242, 243 add additional alternative locations. In other implementations, the club head 216 can be configured with one or more extra or spare weights identical in size and configuration as weights 242, 243, but with different weight distribution or overall weight characteristics. Weights 242, 243 provide the user with greater flexibility in adjusting the overall weight of the club head, and the weight distribution or configuration of the club head. The weights 242, 243 are formed of one or more alloys. In other implementations, the weights can be formed of a heavy metal, other alloys, and combinations thereof.

The disclosed features of golf clubs 10 and 210 provide numerous advantages over existing golf clubs. The weights and sole plates can be easily, simply and conveniently removed, replaced and/or adjusted to obtain a number of different golf club characteristics. The weights and sole plates optimize the adjustability and customization of the club head. The assembly performs well, and allows for the player to quickly and easily adjust the club head to match the golfer's particular needs or objectives at that time. The present assembly also can be readily adjusted into a variety of different settings thereby eliminating the need for the golfer to carry multiple clubs to meet the different desired settings. Further, the present invention provides a golf club that meets these needs while also providing an improved, pleasing aesthetic. The adjustment assembly is also configured for use in competitive play including tournament play by satisfying the requirements of The Rules of Golf as approved by the U.S. Golf Association and the Royal and Ancient Golf Club of St. Andrews, Scotland effective Jan. 1, 2012 ("The Rules of Golf"). Accordingly, the term "assembly is configured for organized, competitive play" refers to a golf club head that fully meets the golf shaft rules and/or requirements of The Rules of Golf.

While the preferred embodiments of the invention have been illustrated and described, it will be appreciated that various changes can be made therein without departing from the spirit and scope of the invention. For example, although different example embodiments may have been described as including one or more features providing one or more benefits, it is contemplated that the described features may be interchanged with one another or alternatively be combined with one another in the described example embodiments or in other alternative embodiments. One of skill in the art will understand that the invention may also be practiced without many of the details described above. Accordingly, it will be intended to include all such alternatives, modifications and variations set forth within the spirit and scope of the appended claims. Further, some well-known structures or functions may not be shown or described in detail because such structures or functions would be known to one skilled in the art. Unless a term is defined in this specification, the terminology used in the present specification is intended to be interpreted in its broadest reasonable manner, even though may be used conjunction with the description of certain specific embodiments of the present invention.

What is claimed is:

1. A golf club head comprising:

a body having a hollow interior, the body comprising:
- a hosel portion;
- a front strike face;
- a crown; and
- a sole comprising a floor and sidewalls extending from the floor to the crown, the floor having openings opening into the hollow interior, the sole defining threaded bores;

a sole plate removably mounted to the sole over the openings of the floor, the sole plate comprising:
- wings proximate the front strike face and curving along the sidewalls and ending at or adjacent to the crown;
- a tail extending from the wings away from the front strike face and ending at or adjacent to the crown; and weight members extending through the sole plate and threadedly engaging the threaded bores in the sole; and wherein the sole comprises a central rib extending along a front-rear centerline of the body.

2. The golf club head of claim 1, wherein the sole plate is T-shaped with the wings extending parallel to the front strike face.

3. The golf club head of claim 1, wherein the sole plate further comprises:
- a first mounting aperture in a first one of the wings and aligned with a first one of the threaded bores;
- a second mounting aperture in a second one of the wings and aligned with a second one of the threaded bores; and
- a third mounting aperture in the tail and aligned with the third one of the threaded bores.

4. The golf club head of claim 3, wherein the weight members comprise a first weight member having a first weight and a second weight member having a second weight different than the first weight.

5. The golf club head of claim 1, wherein the tail has a centerline coincident with a centerline of the body and wherein the sole plate further comprises a head, opposite the tail, projecting from the wings towards the strike plate.

6. The golf club head of claim 1, wherein the sole defines a sole surface area, wherein the openings collectively define an openings surface area, and wherein the openings surface area is at least 15 percent of the sole surface area.

7. The golf club head of claim 6, wherein the openings surface area is at least 20 percent of the sole surface area.

8. A golf club head comprising:

a body having a hollow interior, the body comprising:

a hosel portion;

a front strike face;

a crown; and a sole comprising a floor and sidewalls extending from the floor to the crown, the floor having openings opening into the hollow interior, the sole defining threaded bores; and a sole plate removably mounted to the sole over the openings of the floor, the sole late comprising:

wings proximate the front strike face and curving along the sidewalls and ending at or adjacent to towards the crown; and a tail extending from the wings away from the front strike face and ending at or adjacent to the crown; and weight members extending through the sole plate and threadedly engaging the threaded bores in the sole; and wherein the sole comprises first and second ribs spaced apart by at least one of the openings.

9. The golf club head of claim 1, and the sole comprises a center rib extending along the front-rear centerline of the body and wherein the openings comprise:

a first plurality of openings on a first side of the center rib; and a second plurality of openings on a second side of the center rib, the second plurality of openings symmetrically minoring the first plurality of openings.

10. The golf club head of claim 1, wherein the sole plate is a first sole plate; and further comprising a second sole plate interchangeable with the first sole plate to form a kit, the second sole plate having different weight characteristics than the sole plate.

11. The golf club head of claim 10, wherein the second sole plate has a shape identical to that of the sole plate.

12. The golf club head of claim 1 further comprising a central recessed region in the crown forming a sight line for the golf club head.

13. The golf club head of claim 1, wherein the sole comprises:

a downwardly extending wall extending along the front strike face;

a first upwardly extending recess behind the downwardly extending wall and forming a first lower face of the sole; and a second upwardly extending recess extending from the first lower face of the sole, the second upwardly extending recess receiving the sole plate.

14. The golf club head of claim 1, wherein the sole comprises:

a first recessed cavity removably receiving the sole plate, the first recessed cavity comprising:

a central breast receiving portion;

a neck recess extending from the central breast receiving portion;

wing recesses extending from opposite sides of the central breast receiving portion; and a tail recess;

a second recessed cavity between a first one of the wing recesses and the front strike face on a first side of the body; and a third recessed cavity between a second one of the wing recesses and the front strike face on a second side of the body, wherein the sole plate does not cover the second recessed cavity and is not cover the third recessed cavity.

15. The golf club head of claim 1 further comprising an exposed recess in the sole not covered by the sole plate.

16. The golf club head of claim 1, wherein the body comprises side cavities in the sidewalls of the sole on opposite sides of the tail and rearward the wings.

17. The golf club head of claim 1, wherein the tail extends to a rear edge of the body of the golf club head, opposite the front strike face.

18. The golf club head of claim 8, wherein the sole plate is a first sole plate; and further comprising a second sole plate interchangeable with the first sole plate to form a kit, the second sole plate having different weight characteristics than the sole plate.

19. A golf club head body for use with a set of interchangeable sole plates to form a golf club head, the golf club head body comprising:

a hollow interior;

a hosel portion;

a front strike face;

a crown;

a sole comprising:

a bottom and sidewalls extending from the bottom to the crown;

an upwardly extending recess extending into the bottom and the sidewalls, the upwardly extending recess to receive one of the interchangeable sole plates, the sole defining a sole surface area, the upwardly extending recess having a ceiling with openings that open into the hollow interior, wherein the openings collectively extend over at least 15 percent of the sole surface area;

the sole defining threaded bores; and a central rib extending along a front-rear centerline of the body;

weight members extending through one of the sole plates of the set of interchangeable sole plates and threadedly engaging the threaded bores in the sole;

wherein the sole plates comprise:

wings proximate the front strike face and curving along the sidewalls and ending at or adjacent to the crown; and a tail extending from the wings away from the front strike face and ending at or adjacent to the crown.

20. The golf club head body of claim 19, wherein the upwardly extending recess comprises wing recess portions and a tail recess portion, the wing recess portions extending along the front strike face and the tail recess portion extending rearwardly from the wing recess portions.

21. The golf club head body of claim 20, wherein the wing recess portions extend parallel to the front strike face.

22. The golf club head body of claim 20, wherein the threaded bores include:

a first threaded bore in a first one of the wing recess portions;

a second threaded bore in a second one of the wing recess portions; and a third threaded bore in the tail recess portion.

23. The golf club head body of claim 20, wherein the threaded bores of the sole comprise:

a first threaded bore through the ceiling in a first one of the sidewalls on a first side of the body proximate the front strike face;

a second threaded bore through the ceiling in a second one of the sidewalls on a second side of the body opposite the first side proximate the front strike face; and a third threaded bore through the ceiling proximate a rear of the body opposite the front strike face, the third threaded bore being between and equidistant to the first threaded bore and the second threaded bore.

* * * * *